US006612474B2

(12) United States Patent
Shah

(10) Patent No.: US 6,612,474 B2
(45) Date of Patent: Sep. 2, 2003

(54) HAND-HELD TAPE DISPENSER WITH BRAKE MECHANISM

(76) Inventor: Kumud Shah, P.O. Box 48870, Nairobi (KE)

( * ) Notice: Subject to any disclaimer, the term of this patent is extended or adjusted under 35 U.S.C. 154(b) by 109 days.

(21) Appl. No.: 09/741,854

(22) Filed: Dec. 22, 2000

(65) Prior Publication Data

US 2002/0079345 A1 Jun. 27, 2002

(51) Int. Cl.[7] ..... B26F 3/02; B65H 35/10

(52) U.S. Cl. ..... 225/51; 225/65; 225/82; 156/577; 242/588.3

(58) Field of Search ..... 225/51, 52, 65, 225/79, 82, 87; 156/577; 242/588.3

(56) References Cited

U.S. PATENT DOCUMENTS

| | | | | | |
|---|---|---|---|---|---|
| D116,599 | S | * | 9/1939 | Reinecke | D19/69 |
| D118,629 | S | * | 1/1940 | Reinecke | D19/69 |
| D144,391 | S | * | 4/1946 | Krueger | D19/69 |
| 2,975,950 | A | * | 3/1961 | Kusek | 225/26 |
| 3,125,263 | A | * | 3/1964 | Harbour | 156/523 |
| 3,373,865 | A | * | 3/1968 | Hollins | 225/47 |
| 3,374,139 | A | | 3/1968 | Fritzinger | |
| 3,380,874 | A | * | 4/1968 | Berman | 156/577 |
| 3,489,324 | A | * | 1/1970 | Stohl | 225/37 |
| 3,664,597 | A | | 5/1972 | Norman | |
| D228,579 | S | * | 10/1973 | Stahel, II | D19/69 |
| 3,902,956 | A | * | 9/1975 | Thompson, Jr. | 156/523 |
| 3,968,915 | A | * | 7/1976 | Schleicher | 225/65 |
| 4,121,785 | A | * | 10/1978 | Quenot | 242/396.9 |
| 4,238,272 | A | | 12/1980 | Schleicher | |
| 4,405,068 | A | * | 9/1983 | Blair | 225/65 |
| 4,447,482 | A | * | 5/1984 | Heinzelman et al. | 156/540 |
| D274,825 | S | * | 7/1984 | Lissoni | D19/69 |
| 4,648,538 | A | * | 3/1987 | Lien | 225/78 |
| 4,723,731 | A | * | 2/1988 | Posso | 242/338.1 |
| 4,729,518 | A | | 3/1988 | Mathna et al. | |
| D299,658 | S | * | 1/1989 | Vasilakes et al. | D19/69 |
| 5,171,397 | A | | 12/1992 | Arnold | |
| 5,240,195 | A | | 8/1993 | Klaassen et al. | |
| 5,328,115 | A | * | 7/1994 | Samuelson et al. | 242/588.6 |
| 5,538,170 | A | * | 7/1996 | Van Luit | 225/47 |
| 5,562,262 | A | * | 10/1996 | Pennell | 156/577 |
| 5,564,645 | A | | 10/1996 | Lissoni | |
| 5,759,342 | A | | 6/1998 | Luhman et al. | |
| 5,996,932 | A | * | 12/1999 | Wang | 242/598.5 |
| 6,364,188 | B1 | * | 4/2002 | Dunshee | 225/51 |
| 6,386,416 | B1 | * | 5/2002 | Dunshee et al. | 225/49 |
| 2002/0190091 | A1 | * | 12/2002 | Shah | 225/56 |

FOREIGN PATENT DOCUMENTS

| | | | | |
|---|---|---|---|---|
| CA | 1335089 | | 4/1995 | |
| EP | 0 586 957 | | 3/1994 | |
| GB | 859095 | * | 1/1961 | 225/51 |
| JP | 06287076 | | 7/1996 | |

* cited by examiner

*Primary Examiner*—Allan N. Shoap
*Assistant Examiner*—Jason Prone
(74) *Attorney, Agent, or Firm*—Marks & Clerk

(57) ABSTRACT

A tape dispenser dispenses rolled adhesive tape spirally wound on a hub having an inner cylindrical wall, and an outer cylindrical wall, and a wide "I" cross-section. The dispenser has first and second side members, and a cutter member. Each of the side members has a first major side portion which overlies a roll of adhesive tape within the tape dispenser. The cutter member is mounted between second minor side portions of the side members. A cylindrical axle is formed centrally on the inside surface of the first major side portion of at least one of the side members. There is at least one brake spoke upstanding from the inside surface of that side member, radially extending and spaced away from the cylindrical axle. At least the first side member is flexible in the region of the first major side portion. When the at least first side member is flexed towards the second side member, the at least one brake spoke extends into the annular void on the side of the hub which faces the first side member so as to cause frictional engagement between the at least one brake spoke and at least one of the inner and outer cylindrical walls of the hub. Thus, a braking effect is imparted to the hub so as to preclude unreeling of the spirally wound adhesive tape from the hub.

16 Claims, 4 Drawing Sheets

HAND-HELD TAPE DISPENSER WITH BRAKE MECHANISM

FIELD OF THE INVENTION

This invention relates to hand-held tape dispensers, and particularly to hand-held tape dispensers for adhesive tape of the sort which is used for ordinary household and office purposes. The invention particularly is directed to tape dispensers for dispensing household tape, where the dispenser has a selectively operable brake mechanism to preclude unwanted dispensing or unreeling of the tape, especially when it is being cut. The present invention also provides for tape dispensers which have an improved cutter.

BACKGROUND OF THE INVENTION

Two kinds of tape dispenser are generally known, for two different kinds of tape. One kind of tape is wide tape—typically 6 to 10 cm wide, of the sort which is typically used to seal boxes and cartons, and the like. Many applications of such tape are from automatic machines; however, there are also many hand-held dispensers of the sort which are particularly used in warehouses and stores, for purposes of assembling and/or sealing boxes.

The other kind of adhesive tape which is in very wide usage, and for which the present invention is particularly intended, is that which is used for household or office purposes. Typically, such tape ranges from 1 to 2 cm in width, and may have varying degrees of tackiness depending on whether the tape is intended for permanent use or temporary use. Some such tapes may have a high gloss, others may have a low gloss such that they may be written on and are essentially invisible to imaging equipment such as photocopiers and facsimile machines.

For purposes of the present invention, such adhesive tape is referred to herein as "household tape". Household tape is generally sold and available in two formats: in rolls that are typically sold in boxes, for the purpose of being placed in a dispenser; and already installed in a dispenser. Dispensers, particularly of the hand-held variety, are generally formed of a moulded plastics material, and may or may not be capable of being disassembled for purposes of installing a new roll of adhesive tape therein. It is that kind of hand-held dispenser which is particularly the subject matter of the present invention.

Even such dispensers as are described immediately above may have metal cutters, although generally they are formed with an integral plastic cutter. Metal cutters are more likely to be found, however, on desktop dispensers which are generally very heavy, and into which a roll of household adhesive tape is placed to be dispensed therefrom. Also, metal cutters may be found on older tape dispensers from before 1990 or so.

Of course, any tape dispenser which has a metal cutter generally is such that it has a superior ability to cut tape due to the cutter's sharper and thinner construction; but such tape dispensers are more expensive to manufacture. Even if it were possible to provide plastic cutters which have significant sharpness, they become dull in use, and present somewhat of a danger—especially to the fingers of young children who might well be using household adhesive tape in their play, or for a school project or the like.

Plastic cutters may also accumulate shreds of adhesive tape or particles of adhesive, over time, and become somewhat clogged as a result. On the other hand, it has been discovered that if a plastic cutter—especially one which is molded integrally with the structure of the tape dispenser—is wider than the adhesive tape by at least about 25%, then after the adhesive tape has been unreeled it is possible to achieve a satisfactory cutting effect.

Of even greater concern in most instances is the fact that hand-held adhesive tape dispensers tend to overrun when the tape is being dispensed by pulling on the outer end thereof and unreeling the tape from the roll mounted on a hub within the tape dispenser. Still further, because of the somewhat loose condition of the free end of the tape between where it has left the roll and the cutter, and due particularly as well to the general dullness of plastic cutters, obtaining a clean cut of a particular desired length of tape may be difficult. Quite often, considerable manual dexterity is required, with some experimentation as to aligning the length of the tape which is to be cut from the roll at a particular angle either diagonally or vertically with respect to the cutter.

It has been observed that such difficulties, particularly when the adhesive tape is to be cut, can be overcome by applying some kind of braking action to the unreeled portion of adhesive tape—generally by pressing down with a finger on the tape just behind the cutting edge of the cutter on the dispenser. Even that arrangement is unsatisfactory, requiring considerable manual dexterity, and patience. On the other hand, a braking action applied to the roll of tape, and particularly to the hub on which the adhesive tape has been spirally wound, will achieve the desired braking effect on the tape as it is being cut, thereby permitting an easier cut. Still further, applying minimal braking action on the hub, while at the same time unreeling adhesive tape from the hub, can result in a very specific length of tape being unreeled and cut, if necessary.

It is possible to provide an adhesive tape dispenser for household adhesive tapes where one or both sides of the dispenser has certain flexibility, whereby a braking action can be applied against one or both sides of a roll of tape, or against one or both ends of the hub on which the tape has been spirally wound. Moreover, as a roll of tape is unreeled its diameter becomes smaller, and therefore the side surface of the roll of tape becomes smaller and a braking action against the side of the roll of tape may become less effective. Still further, depending on the conditions in which the tape has been made, spirally wound on the hub, and stored, it is possible that a deposit of adhesive might develop on the inside surface of the side of the tape dispenser if the side has been intermittently pressed against the side surface of the roll of tape, and that condition might cause considerable difficulty in smoothly unreeling adhesive tape away from the roll.

Another manner of applying a braking action is to have a brake element which may selectively be applied against the circumference of the roll of tape. However, because the diameter of the roll of tape decreases as tape is unreeled therefrom, a considerable amount of travel is required for the braking element, especially when the last portions of the adhesive tape are being unreeled from the roll and off the hub on which they have been spirally wound.

DESCRIPTION OF THE PRIOR ART

Several representative examples of tape dispensers, both for industrial and commercial tape which tends to be fairly wide, as noted above, and for narrower household tape, are noted below.

Schleicher U.S. Pat. No. 4,238,272 issued Dec. 9, 1980 teaches a tape dispenser of the sort which may apply either to wide or narrow adhesive tapes, but is particularly of the sort which has relevance to narrow or household adhesive tapes. The device includes a post which extends between panels which are tear-drop shaped and between which the spool of tape is mounted, with the post being mounted in a position which is intermediate the spool of tape and a slot at the end of the dispenser through which the tape is dispensed directly onto a surface. A spring member is attached to the post, with one end having a serrated cutting edge and anvil which are disposed in the slot opening, and the other end impinges resiliently on the supply roll to act as a brake when a cutting action is undertaken.

Mathna et al U.S. Pat. No. 4,729,518, issued Mar. 8, 1988, teaches a tape dispenser of the sort which is a hand-held dispenser typically used for household adhesive tapes, and has a housing with hub and a roll of tape which is journaled on the hub. A paper backcard is disposed around one end of the hub and has a plurality of generally triangular projecting portions which project between the hub and the core. Those projections provide a friction brake between the hub and the core which thereby restricts rotation of the hub to an extent that unwanted rotation of the hub and uncoiling of the tape when it is withdrawn from the dispenser will be precluded. A metal cutter is included.

A self cutting tape dispenser, of the sort which may particularly be useful in commercial and industrial applications, is taught in Arnold U.S. Pat. No. 5,171,397, issued Dec. 15, 1992. Here, the tape dispenser has a moveable cover and a keeper which slides into a circumferential housing so as to keep a roll of tape on an axle. A brake plate is provided, and is such that when tape is being dispensed the thumb is inserted into an opening so as to push the brake plate against the circumference of the roll of tape. In fact, the roll of tape is pushed against the housing back at a time when a tape-cutting blade at the outside wall of the dispenser is pushed against the tape and given a twist so as to cut the tape. The dispenser is intended for one hand operation, and is easily refillable.

Another patent which particularly is directed to a hand-held dispenser used for dispensing industrial or commercial adhesive tape is Luhman et al U.S. Pat. No. 5,754,342, which provides a brake assembly that has a curved brake actuator and a flat brake plate. The structure acts to inhibit free rotation of the tape roll, and therefore the further dispensing of adhesive tape from the roll, when the operator applies pressure by squeezing with the thumb against the brake actuator so as to bend the brake plate about the tape roll and to increase pressure against the tape roll so as to facilitate tape cutting or tape stretching.

SUMMARY OF THE INVENTION

The present invention provides a tape dispenser for dispensing rolled adhesive tape mounted on a hub. The hub on which the rolled adhesive tape comprises an inner cylindrical wall, an outer cylindrical wall, and a centrally located radially extending wall between the inner and outer cylindrical walls, and has a wide "I" cross-section. There is an annular void formed between the inner and outer cylindrical walls at each side of the radially extending wall. The adhesive tape is spirally wound on the hub.

The tape dispenser comprises a first side member, a second side member, and a cutter member. Each of the first and second side members has a first major side portion which overlies a roll of adhesive tape within the tape dispenser, and a second minor side portion at an end of each first and second side members which is remote from the first major side portion.

The cutter member is mounted between the second minor side portions of the first and second side members.

At least one of the first and second side members has a first cylindrical axle portion formed centrally on the inside surface of the first major side portion thereof and upstanding therefrom.

The other of the first and second side members may also have a second cylindrical axle portion formed centrally on the inside surface of the first major side portion thereof also upstanding therefrom. In that case, the first and second cylindrical axle portions are dimensioned so as to fit one inside the other when the first and second side members are assembled together.

At least the first side member has at least one brake spoke upstanding from the inside surface of the first major side portion thereof. The at least one brake spoke is arranged so as to be radially extending away from the first cylindrical axle portion and spaced away from the first cylindrical axle portion.

Typically, there is a plurality of brake spokes upstanding from the first major side portion of the at least first side member, but not necessarily.

At least the first side member is flexible in the region of the first major side portion thereof, so as to be capable of flexing inwardly in a direction towards the second side member.

When the at least flexible first side member is flexed towards the second side member, the brake spokes extend into the annular void which is on the side of the hub which faces the first side member, so as to cause frictional engagement between the plurality of brake spokes and at least one of the inner and outer cylindrical walls of the hub.

Thus, a braking effect is imparted to the hub so as to preclude unreeling of the spirally wound adhesive tape from the hub.

Typically, the cutter member is formed integrally with one of the first and second side members.

Also, the first and second side members are typically formed of a moulded plastics material.

The first and second side members may be disassembled one from the other so as to replace a hub from which adhesive tape has been unreeled with another hub having adhesive tape spirally wound thereon.

In some embodiments of the tape dispenser of the present invention, a plurality of brake spokes may be formed on each of the first side wall member and the second side wall member.

Generally, however, the brake spokes are formed only on the first side member. Also, a plurality of arcuate ribs may be formed on the inside surface of the first major side portion of the first side member. The arcuate ribs are spaced away from the first cylindrical axle portion, and are interposed among the plurality of brake spokes.

At least one channel may be formed through the thickness of the material of the first major side portion of the first side member, in the region of and extending from each of the arcuate ribs.

In another embodiment, there may be two channels which are formed through the thickness of the material of the first major side portion of the first side member, for each of the arcuate ribs, one of the two channels extending from each end of each of the arcuate ribs.

The first cylindrical axle portion may be dimensioned so as to be fitted inside the second cylindrical axle portion, when the tape dispenser is in an assembled condition.

The configuration of the brake spokes may be such that they will engage the outside annular end surface of the inner cylindrical wall of the hub.

Also, the plurality of brake spokes and the plurality of arcuate ribs may be configured so as to contact the outer cylindrical wall of the hub, and thereby maintain the hub centered over the axle portions.

Typically, there are three brake spokes and three arcuate ribs which are formed on the inside surface of the first major side portion of the first side member.

In particular embodiments of the tape dispenser of the present invention, the second minor side portion of each of the first and second side members is flared upwardly and outwardly in the region of the cutter member. The cutter member has a serrated outer cutting edge which is placed high in the region of the flared second minor side portions, and the width of the cutting edge exceeds the width of the adhesive tape on the hub within the tape dispenser, by at least 25%.

In such a tape dispenser as described immediately above, the cutting edge may be aligned at an angle to each of the flared second minor side portions.

In keeping with another provision of the present invention, a cutter member assembly for a tape dispenser is provided, where the tape dispenser may not necessarily be one which has flexible side members or a specific brake member or braking action. In any event, the cutter member is mounted in an upper region of an end of the tape dispenser which is remote from the region where the hub is mounted. The side members of the tape dispenser are flared upwardly and outwardly in the region of the cutter member, which has a serrated outer cutting edge which is placed high in the region of the upwardly and outwardly flared side members. The width of the cutting edge exceeds the width of the adhesive tape on the hub within the tape dispenser, by at least 25%.

Once again, the cutting edge may be aligned at an angle to each of the upwardly and outwardly flared side members.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
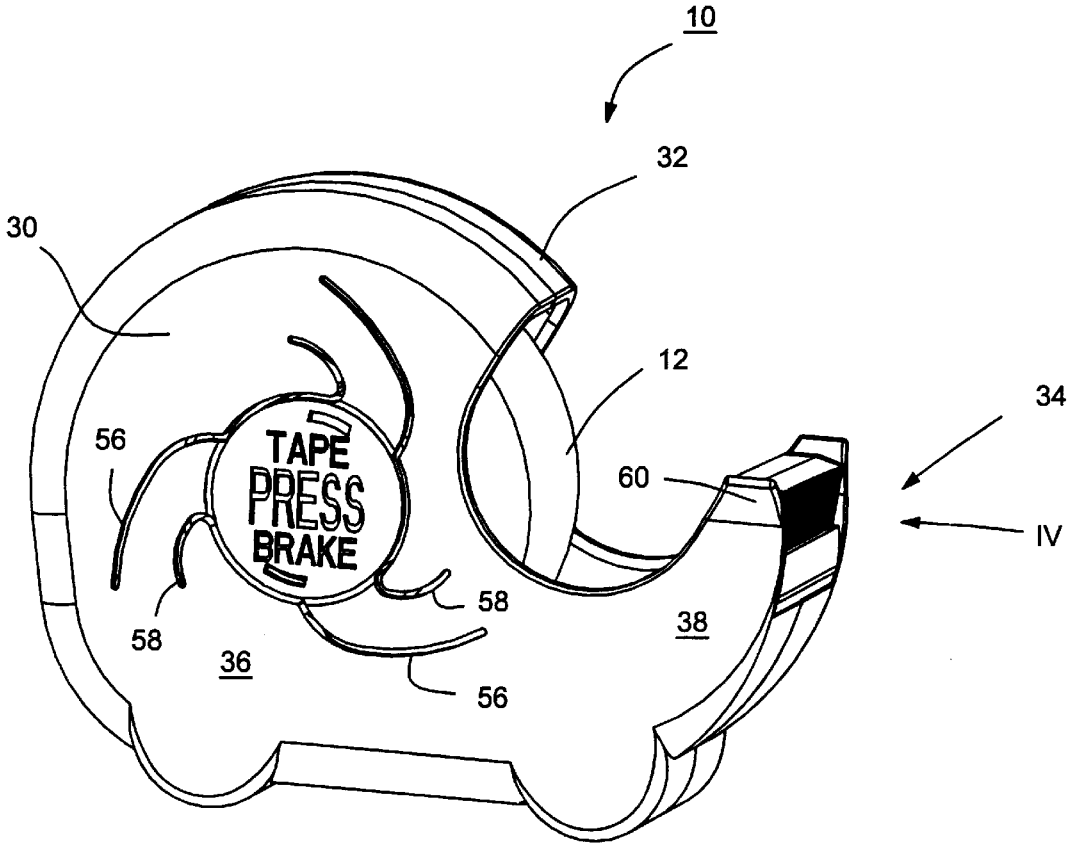
FIG. 1 is a general perspective view of an assembled tape dispenser, in keeping with the present invention.
Figure 2:
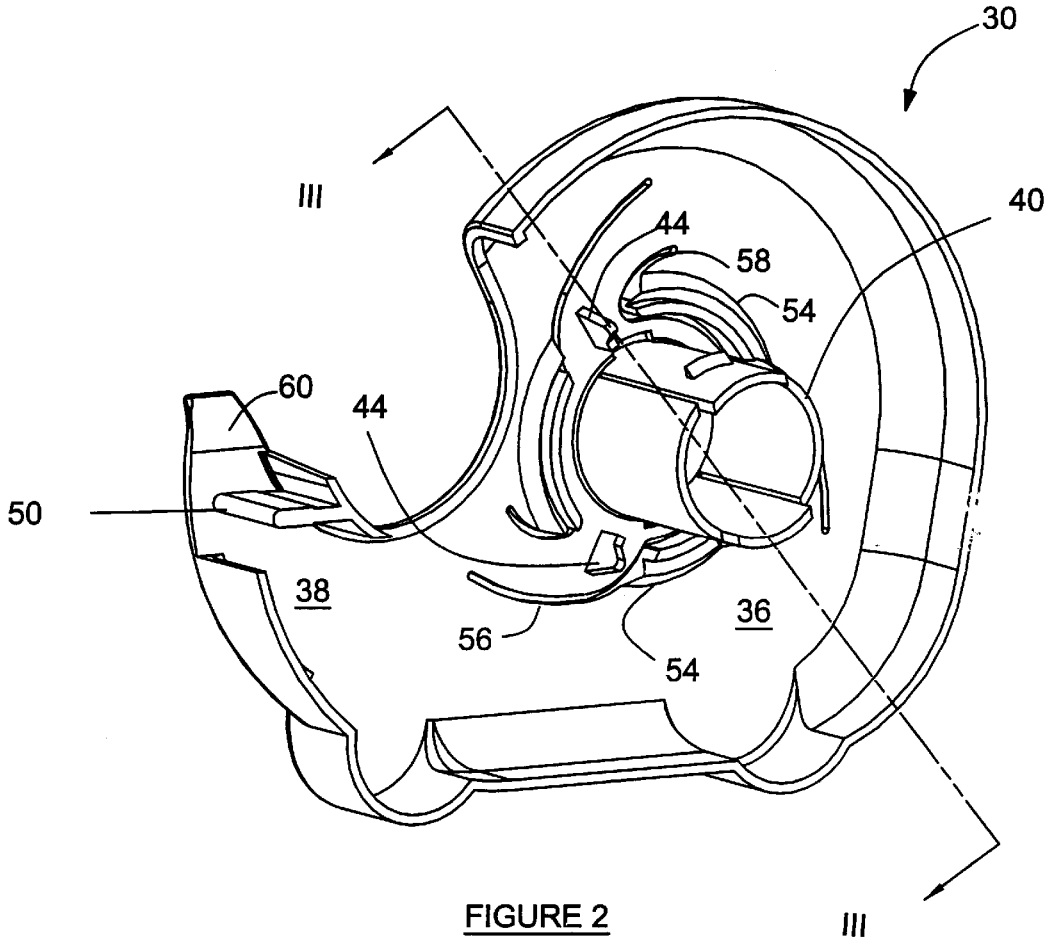
FIG. 2 is a perspective view of the inside surface of a first side member of a tape dispenser in keeping with the present invention.
Figure 3:
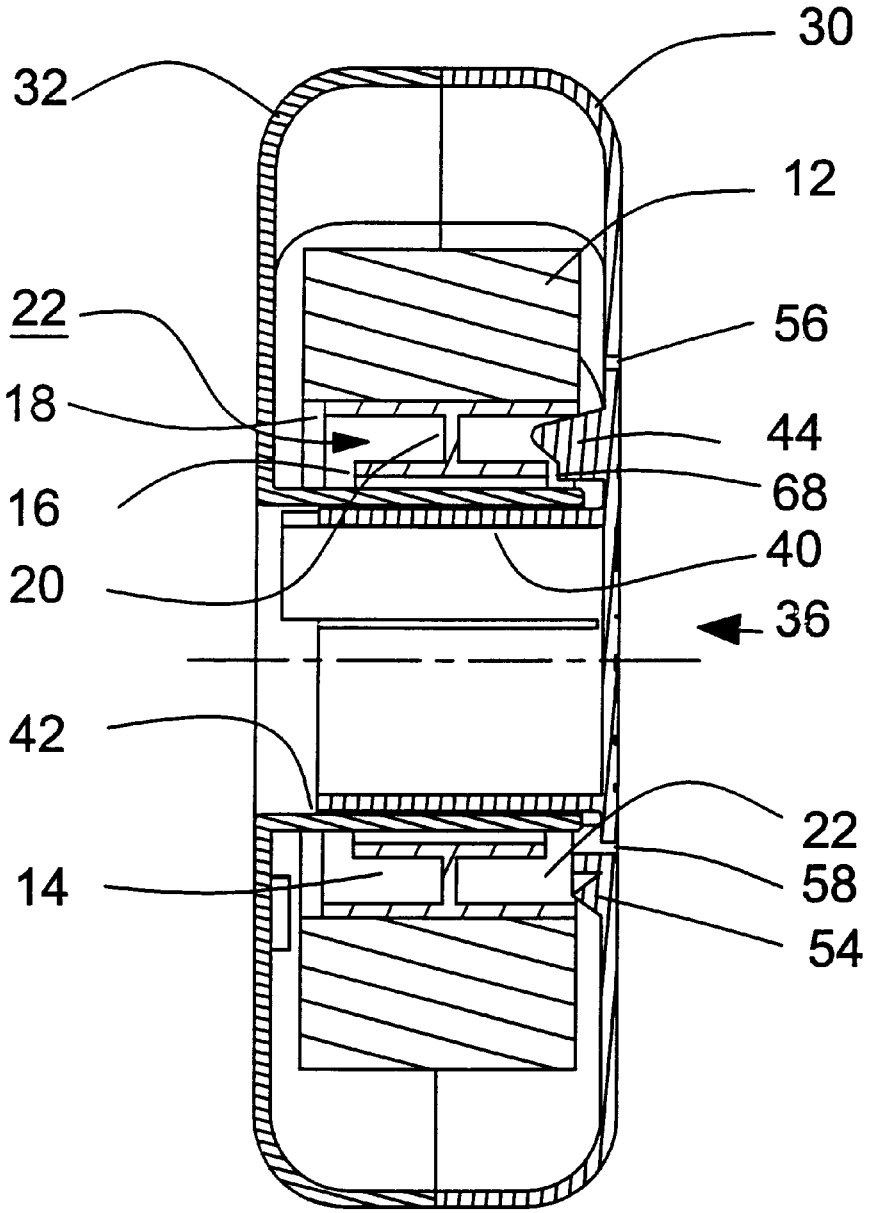
FIG. 3 is a cross-section taken in the direction of arrows III—III in FIG. 2.

Turning first to FIGS. 1 to 3, some general features of a tape dispenser in keeping with the present invention are now discussed.

A tape dispenser 10 is shown in assembled form at 10 in FIG. 1, having a roll of adhesive tape 12 placed within the dispenser 10, and being in a condition such that adhesive tape can be unreeled from the roll 12. In well known fashion, the adhesive tape is spirally wound on the roll 12, and is unreeled therefrom when the tape is pulled from the roll in an essentially tangential direction and the roll is rotated clockwise as seen in FIG. 1.

In any event, as seen in FIG. 3, the rolled adhesive tape 12 is mounted on a hub 14, onto which it is spirally wound. The hub 14 comprises an inner cylindrical wall 16 and an outer cylindrical wall 18. A centrally located radially extending wall 20 is located between the inner and outer cylindrical walls 16, 18, and thus the cross-section of the hub 14 is such as to have a wide "I" cross-section as seen particularly in FIG. 3. An annular void 22 is formed between the inner and outer cylindrical walls 16, 18 at each side of the radially extending wall 20, again as seen particularly in FIG. 3.

The tape dispenser comprises two side members; a first side member 30—which is shown in more detail in FIG. 2, discussed hereafter—and a second side member 32. A cutter member 34 is shown generally in FIG. 1, and is discussed in greater detail hereafter with respect to FIG. 4.

Each of the first and second side members 30, 32 has a first major side portion 36 which overlies the roll of adhesive tape 12 within the tape dispenser, and a minor side portion 38 which is at an end of the tape dispenser 10 that is remote from the first major side portion 36. These first and second major and minor side portions, 36, 38, respectively, are seen particularly in FIGS. 1 and 2. It can also be seen particularly in FIGS. 1 and 4 that the cutter member 34 is mounted between the second minor side portions 38 of the first and second side members 30, 32.

As seen particularly in FIGS. 2 and 3, at least one of the first side member 30 and the second side member 32 has a first cylindrical axle portion 40 (shown, in this case, on the first side member 30) which is formed centrally on the inside surface of the first major side portion 36, and is upstanding therefrom—particularly as noted in FIGS. 2 and 3.

The other side member may also have a second cylindrical axle portion 42 which is formed centrally on the inside surface of its first major side portion 36; and if so, the second cylindrical axle portion 42 is also upstanding from the inside surface of the first major side portion 36 thereof, as seen in FIG. 3. It will also be seen from FIG. 3 that the first and second cylindrical axle portions 40, 42 are dimensioned so as to fit one inside the other when the first and second side members 30, 32 are assembled together. As noted, when there is only a single axle portion 40, it may be upstanding from, and formed integrally with, either of the first or second side members.

Again, referring particularly to FIGS. 2 and 3, it will be seen that there is at least one brake spoke 44 which is upstanding from the inside surface of the first major side portion 36 of at least the first side member 30. Typically, there is a plurality of brake spokes 44.

As can be seen particularly in FIG. 2, the brake spokes 44 are arranged so as to be radially extending away from the first cylindrical axle portion 40, and they are spaced radially away from the first cylindrical axle portion 40.

In keeping with a particular provision of a preferred embodiment of the present invention, at least the first side member 30 is flexible in the region of the first major side portion 36. Thus, the first major side portion 36 of the first side member 30 is capable of flexing inwardly, in a direction towards the second side member 32. Having regard to FIG. 3, the first major side portion 36 of the first side member 30 is capable of being flexed in a direction to the left, towards the second side member 32.

It will also be seen from FIG. 3 that, when the at least first side member 30 is flexed in its first major side portion 36, towards the second side member 32, the brake spokes 44 will extend into the annular void 22 on that side of the hub 14 which faces the brake spokes 44, and thus which faces the side member 30. It follows, therefore, that frictional engagement will occur between the plurality of brake spokes 44 and at least one of the inner and outer cylindrical walls 16, 18 of the hub 14.

Thus, a braking effect is imparted to the hub 14, which inturn precludes further unreeling of the spirally wound adhesive tape 12 from the hub 14.

Accordingly, as the adhesive tape is unreeled from the roll of adhesive tape 12 wound on the hub 14, generally by having first lifted it away from the cutter member 34 and pulling it away from the roll of adhesive tape, then when it is desired to stop further unreeling of the adhesive tape and to cut the then selected length of adhesive tape using the cutter member 34, the sides of the tape dispenser 10 are squeezed so as at least to move the flexible portion of the first side member 30 towards the second side member 32 and cause the braking effect. The squeezing action is generally effected by squeezing the tape dispenser between the thumb and fingers of the hand.

When a desired length of tape has been unreeled from the roll of adhesive tape 12, it is then lowered over the cutter member 34, and the tape is cut, typically by a combination of lowering the loose end of the tape, while in tension, below the cutter member 34 and imparting a relative twisting motion between the cutter member 34 and the length of adhesive tape to be cut off.

Figure 4:
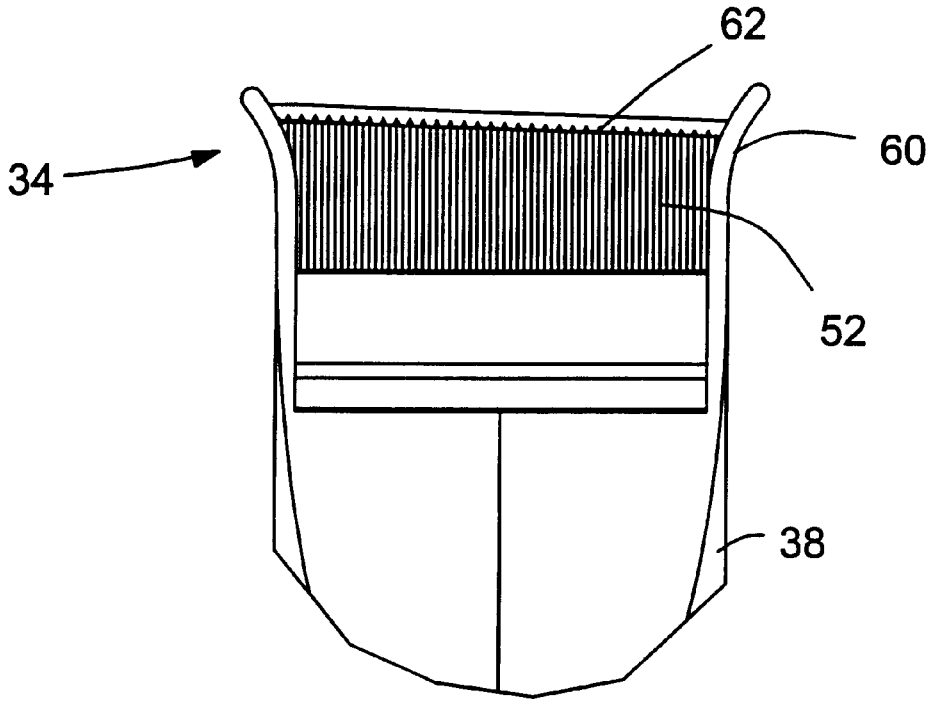
FIG. 4 is a fragmentary top view of the portion IV indicated in FIG. 1.

To that end, the cutter member assembly typically includes a reinforcing or stiffening rib 50, shown in FIG. 2, together with the cutter member blade 52, which is shown in FIG. 4. Typically, the cutter member blade 52 is formed integrally with one of the first and second side members—in this case, it is formed integrally with side member 32, and is formed so as to overlie the reinforcing rib 50.

Typically, the first and second side members of the tape dispenser 10 are formed of a molded plastics material such as a styrene-based plastics material, or possibly a polycarbonate.

Moreover, the tape dispenser 10 may be formed such that the first and second side members 30, 32 may be disassembled one from the other so as to replace a hub 14 from which the adhesive tape 12 has been unreeled, with another hub 14 on which a new supply of adhesive tape 12 has been spirally wound.

Obviously, a tape dispenser in keeping with the present invention may be designed so as to have a plurality of brake spokes 44 formed on the inner surface of each of the first major side portions 36 of each of the first and second side members 30, 32. However, it has been discovered that a quite satisfactory braking effect can be imparted to the hub 14 by the particular embodiment which is illustrated, having the brake spokes 44 molded only on one of the side members.

The question of stiffness and flexibility of the side members is one which may be important, particularly in certain commercial embodiments of the tape dispenser of the present invention. Stiffness of the first major side portion 36 of the at least first side member 30 which has the brake spokes 44 formed thereon can be imparted by the presence of a plurality of arcuate ribs 54 which are also formed on the inside surface of the first major side portion 36 of that first side member 30. Here, the arcuate ribs 54 are spaced radially away from the first cylindrical axle portion 40, and are interposed among the plurality of brake spokes 44.

Moreover, so as to provide flexibility of the first major side portion 36 of the at least first side member 30, at least one channel 56 or 58 may be formed through the thickness of the material of the first major side portion 36 of the first side member 30, each in the region of and extending from each of the arcuate side ribs 54. This is seen particularly in FIG. 3.

Indeed, typically there are the two channels 56, 58 which are formed through the thickness of the material of the first major side portion 36 of the first side member 30, for each of the arcuate ribs 54. One of the channels 56, 58 extends from one end of the respective arcuate rib 54, and the other channel extends from the other end of the arcuate rib 54, as seen particularly in FIGS. 1 and 2.

Typically, when a tape dispenser 10 is assembled, in keeping with the present invention, the first cylindrical axle portion 40 is fitted inside the second cylindrical axle portion 42, as can be seen in FIG. 3.

It will also be noted that the configuration of the brake spokes 44 may be such, as seen particularly in FIGS. 2 and 3, that a stepped configuration 68 is employed at the end of the brake spokes 44 in the region thereof which faces the inner cylindrical wall 16 of the hub 14. This assumes contact between the brake spokes 44 and each of the cylindrical walls 16, 18 of the hub 14 when a braking action is to be imparted to the hub 14.

Moreover, the plurality of brake spokes 44 and the plurality of arcuate ribs 54 may each be configured so as to contact the outer cylindrical wall 18 of the hub 14, in such a manner as shown in FIG. 3, so as to maintain the hub 14 centered over the assembled axle portions 40, 42. This is because the inside diameter of the inner cylindrical wall 16 is greater than the outside diameter of the second cylindrical axle portion 42. However, so as to preclude binding or uneven withdrawal or unreeling of the adhesive tape away from the roll, it is best for the hub 14 to be centered over the assembled axle portions 40, 42 but not in binding contact therewith.

It has been found that three brake spokes 44, and three arcuate ribs 54, formed on the inside surface of the first major side portion 36 of the first side member 30, will provide very satisfactory performance of the tape dispenser 10 as described herein. However, that description and illustration of three brake spokes 44 and three arcuate ribs 54 is not intended to be limiting, but is by way of example only. Any number of brake spokes and arcuate ribs may be employed—but typically, at least three and, for practical purposes, less than seven.

Now, directing our attention to discussion of the cutter member 34, it will be seen from each of FIGS. 1, 2, and 4, that the second minor side portions 38 of each of the first and second side members 30, 32 may be flared upwardly and outwardly, as shown at 60, in the region of the cutter member 34. It will be seen particularly from FIG. 1 that the cutter member 34, and specifically the cutter blade 52 thereof, is placed high in the region of the flared second minor side portions 38 of each of the first and second side members 30, 32, and that there is a serrated outer cutting edge 62 provided for the cutter member 34 on the cutting blade 52.

In keeping with a particular provision of the present invention, the width of the cutting edge 62 exceeds the width of the adhesive tape 12 by at least 25%. That additional width, together with the flared portion 60, permits easy access of the adhesive tape 12 to the cutter member 34 as the adhesive tape is lowered over the cutter member for cutting. It will be recalled that, typically, the adhesive tape 12 is in tension at the time, due to the braking action on the hub 14.

Another purpose which is served, of course, by the flared portions 60 is to reduce the possibility of injury—cutting the finger of the user, in particular—from the wide cutter member 34.

It has been found that a particularly effective cutting action can be obtained if the cutting edge 62 is aligned at a small angle to each of the flared second minor side portions 60, as seen in FIG. 4. This slightly angled cutting edge 62 more easily accommodates starting the cutting action when the tape has been lowered onto the cutter member 34 and a relative twisting motion is effected between the adhesive tape and the cutter member.

Another aspect of the present invention provides for the cutter member assembly 34 to be arranged with any tape dispenser, such as a tape dispenser of the prior art. However, it is a provision of the present invention that, even when the cutter member is provided with a prior art tape dispenser, it is mounted in an upper region of the end of the tape dispenser which is remote from the region of the hub of the roll of tape is mounted. Moreover, the side members of the tape dispenser should be flared upwardly and outwardly in the region of the cutter member, which has a serrated outer cutting edge, the width of which exceeds the width of the adhesive tape by at least 25%.

Again, typically the cutting edge is aligned at an angle to each of the upwardly and outwardly flared side members of the tape dispenser.

It will be evident that, in some circumstances, the assembly of the brake mechanism of the present invention, including particularly the first cylindrical axle portion 40, and the brake spokes 44, can be formed as a separate component which is not an integral portion of the side member, but is suspended or mounted therein in a suitable fashion.

There has been described tape dispenser which functions particularly to preclude unwanted unreeling of the adhesive tape from a roll thereof, particularly as the adhesive tape is to be cut. A cutter member for a tape dispenser has also been provided, which cutter member can be applied to prior art tape dispensers.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Other modifications and alterations may be used in the design and manufacture of the apparatus of the present invention without departing from the spirit and scope of the accompanying claims.

What is claimed is:

1. A tape dispenser for dispensing rolled adhesive tape mounted on a hub; where the hub comprises an inner cylindrical wall, an outer cylindrical wall, and a centrally located radially extending wall between said inner and outer cylindrical walls, so as to have a wide "I" cross-section, and an annular void formed between said inner and outer cylindrical walls at each side of said radially extending wail; and where said adhesive tape is spirally wound on said hub; said tape dispenser comprising:

a first side member, a second side member, and a cutter member;

wherein each of said first and second side members has a first major side portion which overlies a roll of adhesive tape within said tape dispenser, and a second minor side portion at an end thereof remote from said first major side portion; each of said side portions having a respective inside surface;

wherein said cutter member is mounted in a region between said second minor side portions of said first and second side members;

at least one of said first and second side members having at least a first cylindrical axle portion formed centrally on the inside surface of the first major side portion thereof, and upstanding therefrom;

at least said first side member having at least one brake spoke upstanding from the inside surface of the first major side portion thereof, said at least one brake spoke being arranged so as to be radially extending away from said first cylindrical axle portion and spaced away therefrom;

wherein at least said first side member is flexible in the region of said first major side portion thereof so as to be capable of flexing inwardly in a direction towards said second side member; and wherein, when said at least said first side member is flexed towards said second side member, said at least one brake spoke extends into said annular void on the side of said hub which faces said first side member so as to cause frictional engagement between said at least one brake spoke and at least one of said inner and outer cylindrical walls of said hub;

whereby a braking effect is imparted to said hub so as to preclude unreeling of the spirally wound adhesive tape from said hub.

2. The tape dispenser of claim 1, wherein there is a plurality of brake spokes upstanding from the inside surface of the first major side portion of said at least first side member.

3. The tape dispenser of claim 1, wherein said first side member has said first cylindrical axle portion formed centrally on the inside surface of the first major side portion thereof, and upstanding therefrom; and wherein said second side member has a second cylindrical axle portion formed centrally on the inside surface of the first major side portion thereof, and upstanding therefrom;

said first and second cylindrical axle portions being dimensioned so as to fit one inside the other when said first and second side members are assembled together.

4. The tape dispenser of claim 1, wherein said first and second side members are formed of molded plastics material.

5. The tape dispenser of claim 4, wherein said first and second side members may be disassembled one from the other so as to replace a hub from which adhesive tape has been unreeled with another hub having adhesive tape spirally wound thereon.

6. The tape dispenser of claim 2, wherein a plurality of brake spokes is formed on each of said first side wall member and said second side wall member.

7. The tape dispenser of claim 2, further comprising a plurality of arcuate ribs formed on the inside surface of said first major side portion of said first side member, wherein said arcuate ribs are spaced away from said first cylindrical axle portion, and are interposed among said plurality of brake spokes.

8. The tape dispenser of claim 7, further comprising at least one channel formed through the thickness of the material of said first major side portion of said first side member, in the region of and extending from each of said arcuate ribs.

9. The tape dispenser of claim 8, wherein there are two channels formed through the thickness of the material of said first major side portion of said first side member for each of said arcuate ribs, one extending from each end of each of said arcuate ribs.

10. The tape dispenser of claim 3, wherein said first cylindrical axle portion is fitted inside said second cylindrical axle portion when said tape dispenser is in an assembled condition.

11. The tape dispenser of claim 2, wherein each of said brake spokes is configured so as to engage the outside annular end surface of said inner cylindrical wall of said hub.

12. The tape dispenser of claim 7, wherein said plurality of brake spokes and said plurality of arcuate ribs are each configured so as to contact said outer cylindrical wall of said hub, so as to maintain said hub centered over said axle portions.

13. The tape dispenser of claim 6, wherein three brake spokes and three arcuate ribs are formed on the inside surface of said first major side portion of said first side member.

14. The tape dispenser of claim 4, wherein said second minor side portion of each of said first and second side members is flared upwardly and outwardly in the region of said cutter member, wherein said cutter member has a serrated outer cutting edge which is placed high in the region of said flared second minor side portions, and wherein each of a tape to be dispensed and said cutting edge has a width, and the width of said cutting edge exceeds the width of said adhesive tape by at least 25%.

15. The tape dispenser of claim 14, wherein said cutting edge is aligned at an angle to each of said flared second minor side portion.

16. The tape dispenser of claim 4, wherein said cuter member is molded integrally with one of said first and second side members.

* * * * *